US006234693B1

(12) United States Patent
Gregoire et al.

(10) Patent No.: US 6,234,693 B1
(45) Date of Patent: May 22, 2001

(54) DEVICE FOR OFFSETTING A POSTAGE IMPRINT

(75) Inventors: Jean-Pierre Gregoire, Brie-Comte-Robert; Thierry Le Jaoudour, Verrieres le Buisson, both of (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 09/441,950

(22) Filed: Nov. 17, 1999

(30) Foreign Application Priority Data

Nov. 24, 1998 (FR) ..... 98 14756

(51) Int. Cl.[7] ..... B41J 3/42

(52) U.S. Cl. ..... 400/73; 101/32; 101/485; 347/19

(58) Field of Search ..... 400/73; 101/232, 101/485; 271/100, 110, 37, 186, 9.11; 347/19

(56) References Cited

U.S. PATENT DOCUMENTS

| | | | | |
|---|---|---|---|---|
| 3,612,511 | * | 10/1971 | Godlewski | 271/110 |
| 3,834,691 | * | 9/1974 | Paulson | 271/100 |
| 3,881,296 | * | 5/1975 | Bate | 53/442 |
| 4,541,623 | * | 9/1985 | Huerta | 271/37 |
| 5,203,263 | | 4/1993 | Berger et al. . | |
| 5,464,099 | * | 11/1995 | Stevens et al. | 371/186 |
| 5,651,445 | * | 7/1997 | Stevens et al. | 271/9.11 |
| 5,813,327 | * | 9/1998 | Freeman et al. | 101/232 |
| 5,988,252 | * | 11/1999 | Carroll | 156/240 |
| 6,106,095 | * | 8/2000 | Jackson et al. | 347/19 |

FOREIGN PATENT DOCUMENTS

| | | |
|---|---|---|
| 0 589 722 A2 | 3/1994 | (EP) . |
| 0 615 212 A2 | 9/1994 | (EP) . |
| 2 759 186 A1 | 8/1998 | (FR) . |

* cited by examiner

*Primary Examiner*—Eugene Eickholt
(74) *Attorney, Agent, or Firm*—Sughrue, Mion, Zinn, Macpeak & Seas, PLLC

(57) ABSTRACT

A device for offsetting a postage imprint in a mail-handling machine, the device comprising detection means for detecting an edge of a mail item, print means for printing a postage imprint on the mail item, and monitoring and control means connected firstly to said detection means and secondly to said print means so as to control printing of said postage imprint on said mail item as a function of a predetermined standard offset $\Delta_0$ on the basis of the detection of said edge of the mail item, the detection means for detecting an edge of the mail item comprising means for retarding the detection of the edge of the mail item as a function of the thickness of the mail item, which thickness is determined using said detection means for detecting an edge of a mail item.

10 Claims, 4 Drawing Sheets

DEVICE FOR OFFSETTING A POSTAGE IMPRINT

FIELD OF THE INVENTION

The present invention relates to the field of mail handling, and it relates more particularly to a device serving, in a mail-handling machine, to offset the postage imprint printed on a mail item, the offset being a function of the dimensional characteristics of the item, and in particular its thickness.

PRIOR ART

Conventionally, a mail-handling machine must be suitable for receiving various types of mail item, such as documents, labels, and envelopes or "covers", that have dimensions that are very different with various lengths and thicknesses being encountered. Patent Document U.S. Pat. No. 4,638,732 issued in 1987 shows a mail-handling machine in which the position at which the postage imprint is to be printed relative to the edge of a mail item is determined as a function of the speed at which the item is advancing through the machine, as measured by means of two sensors spaced apart at a determined distance, and placed on the path along which the mail items are conveyed. That reference position is set once and for all by the control means of the machine. Unfortunately, the thicker the mail item, the more the postage imprint in the vicinity of the edge of the mail item is subject to deformation. A keypad is thus provided on which two keys enable the reference position to be displaced in increments forwards and backwards to take account of any variation in the thicknesses of mail items.

Nearly ten years later, at the end of 1995, Patent Document U.S. Pat. No. 5,479,586 merely proposed adding light-emitting diodes to the keypad to inform the operator of the increment chosen for the displacement of the postage imprint relative to the reference position as determined by the speed of advance of the mail item.

However, in both of those two structures, mail item thickness is taken into account manually by the operator. As a result, the mail-handling process must be slowed down, which is unacceptable when it is necessary to handle large volumes of mail having dimensional characteristics that vary frequently.

A first solution to the problem posed by the rate of handling being slowed down is provided by the Applicant's French Patent Application No. 97 01054. That solution enables the print cycle command for printing the postage imprint to be offset as a function of mail item thickness. Unfortunately, the device claimed requires the presence of two sensors, namely a conventional sensor for detecting the edge of the envelope, and a special sensor for measuring the thickness of the envelope, it also being necessary for the control means to be adapted to enable the print cycle to be modified as a function of various ranges of thickness. In addition, it should be noted that the second sensor must be of quite high precision, and it is therefore necessary to use a rather complex magnetic probe of the Hall-effect type.

OBJECT AND DEFINITION OF THE INVENTION

An object of the present invention is to propose an improved device enabling the postage imprint printed on mail items to be offset automatically. In particular, an object of the invention is to provide a device that is particularly simple and reliable, and, in particular, that does not require the print control cycle for printing the postage imprint to be modified, unlike the first application by the Applicant.

These objects are achieved by a device for offsetting a postage imprint in a mail-handling machine, the device comprising detection means for detecting an edge of a mail item, print means for printing a postage imprint on the mail item, and monitoring and control means, advantageously of the microprocessor type, connected firstly to said detection means and secondly to said print means so as to control printing of said postage imprint on said mail item as a function of a predetermined standard offset $\Delta_0$ on the basis of the detection of said edge of the mail item, wherein said detection means for detecting an edge of the mail item comprise means for retarding the detection of the edge of the mail item as a function of the thickness of the mail item, which thickness is determined using said detection means for detecting an edge of a mail item.

Thus, as with the Applicant's prior art device, manual action is no longer necessary to adapt the position of the postage imprint as a function of the thickness of the mail item, and, in addition, the means for controlling the print cycle are not modified. Moreover, there is no longer any need for a special second sensor (Hall-effect probe), since the detection means are limited to a single sensor which detects both the edge of the envelope and the thickness thereof. By means of their particular structure, various thicknesses of the mail items are taken into account simply and particularly reliably.

Advantageously, and unlike the prior art devices, the detection means detect both an edge of an envelope, and an edge of a label.

Preferably, said detection means comprise a swan-necked bell-crank having a convex top portion which is terminated by a detection end, and a concave bottom portion which is terminated by a feeler end, a pin about which the crank can rock being situated substantially where the two portions meet. Said feeler end is provided with an impact zone which co-operates with said edge of the mail item, and which has a profile that slopes down to a predetermined depth h below the level corresponding to a top surface of the mail item, which surface is defined by a reference top plate of the conveyor path along which the mail items are conveyed. Preferably, said impact zone is formed of a flat sloping at about 45° to the horizontal.

The invention also provides a device for detecting an edge of a mail item in a mail-handling machine, said device comprising a swan-necked bell-crank having a convex top portion which is terminated by a detection end, and a concave bottom portion which is terminated by a feeler end, a pin about which the crank can rock being situated substantially where the two portions meet. The feeler end is provided with an impact zone which has a sloping profile serving to co-operate with said edge of the mail item.

The invention also provides a method of offsetting a postage imprint in a mail-handling machine, said method comprising a first step using detection means to detect an edge of a mail item, a second step using monitoring and control means connected to said detection means to deliver a predetermined standard offset $\Delta_0$ on the basis of the detection of said edge of a mail item, and a third step using print means connected to said monitoring and control means to print the postage imprint on the mail item, wherein the detection of the edge of the mail item that is performed in the first step is retarded as a function of dimensional characteristics of the mail item, as determined using said detection means for detecting an edge of the mail item. Said dimensional characteristics are advantageously constituted by the various thicknesses of the selected mail items.

BRIEF DESCRIPTION OF THE DRAWINGS

Other characteristics and advantages of the present invention appear more clearly from the following description given by way of non-limiting example and with reference to the accompanying drawings, in which.

DETAILED DESCRIPTION OF A PREFERRED EMBODIMENT

Figure 1:
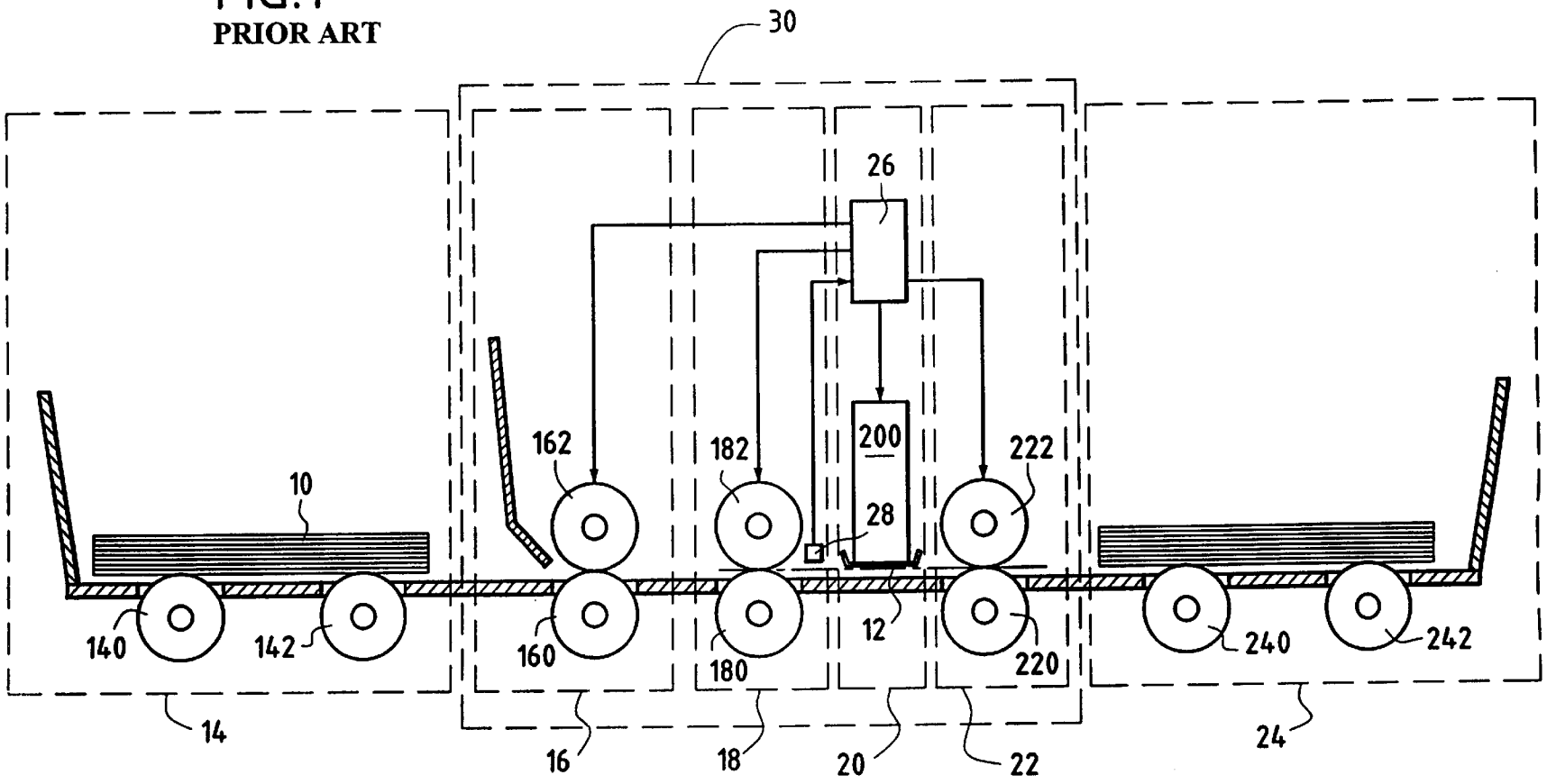
FIG.1 PRIOR ART
FIG. 1 is a highly diagrammatic view of a conventional structure of a mail-handling machine.

FIG. 1 is a highly diagrammatic view showing the various components of a mail-handling machine. In the direction in which the mail items 10 advance along a conveyor path 12, the machine includes: a mail item feed device 14 serving to receive a stack of mail items which can have differing dimensional characteristics, and in particular which can be of different thicknesses, said feed device being provided with motor-driven drive rollers 140, 142; a selection device 16 for individually selecting each mail item from the stack, which selection device is provided with selection rollers and backing rollers 160, 162; an upstream conveyor device 18 for conveying each selected item, which conveyor device is provided with upstream conveyor rollers and backing rollers 180, 182; a postage metering or "franking" device 20 for printing a postage imprint on each selected mail item, which franking device advantageously includes an ink jet print module 200; a downstream conveyor device 22 for conveying each franked item, which downstream conveyor device is provided with downstream conveyor rollers and backing rollers 220, 222; and a mail item storage device 24 serving to receive all of the printed mail items, which storage device is provided with motor-driven drive rollers 240, 242. Naturally, the mail-handling machine further includes monitoring and control means (in particular microprocessor-type means 26) for managing printing on the mail items and their travel through the machine along the conveyor path 12. Detection means 28 for detecting that edge of a mail item on the basis of which the printing of the postage imprint is synchronized (as a function of a predetermined standard offset $\Delta_0$ defining a reference position for the printing) are connected to said monitoring and control means. The machine may also include a label dispenser (not shown) then equipped with its own detection means for detecting the edge of a label. In practice, the monitoring and control means and the selection, conveying, and franking devices may be organized in a single module 30 as described below with reference to FIG. 2.

Only a top portion of this module is shown diagrammatically, above the conveyor path 12 along which the mail items are conveyed. In the direction of advance of the mail items, and in a module body 32 secured to or integral with the body of the mail-handling machine, the top portion of this module includes the selection backing roller 162, the upstream conveyor roller 182, the ink jet print module 200, and the downstream conveyor backing roller 222 (the motor-driven drive rollers 160, 180, 220 co-operating with the backing rollers and disposed below the conveyor path 12 are not shown). A label dispenser 34 mounted on the body of the module 32 and including a roller 340 for propelling labels is interposed between the selection backing roller 162 and the upstream conveyor roller 182 so that an outlet channel 342 via which the labels are output from the dispenser joins the conveyor path 12 immediately upstream from the upstream conveyor backing roller 182. At the print module 200, the top portion of the conveyor path is formed by a reference top plate 36 against which the mail items are pressed for the purpose of printing them.

This module of the mail-handling machine includes the detection means 28 for detecting an edge of a mail item which, in the invention, may be either an envelope extracted from the feed device 14 and then selected individually by the selection device 16, or else a label coming directly from the dispenser 34. These detection means are constituted essentially by a bell-crank 280 which is mounted to rock about a pin 282 whose ends are secured to a stationary portion of the module (e.g. the body of the module 32 or preferably the label dispenser 34) on either side of the conveyor path 12. The crank is provided with two opposite ends: firstly a feeler end 284 serving to come into contact directly with the mail item, and secondly a detection end 288 (e.g. a conventional fork detector sold by OPTEK under No. OPB 360L55) for delivering a signal to the monitoring and control circuit 26, which signal represents the detection of the edge of the mail item passing under the feeler opposite end. The pin of the crank is surrounded by a helical return spring 290 serving to press the feeler end of the crank properly against the mail items even when the mail that is being handled is thin, e.g of thickness less than 1 mm, such as a label.

Figure 3:
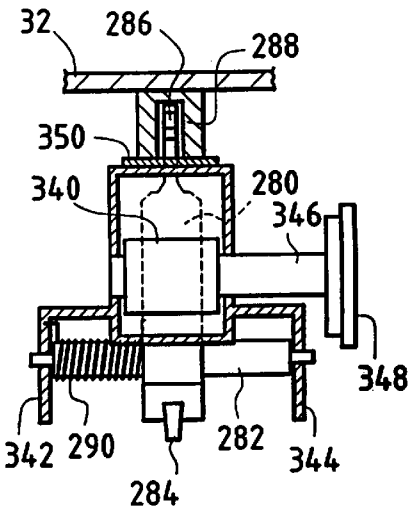
FIG. 3 is a view on plane IV—IV of the module of FIG. 2.

FIG. 3 is a section view of the label dispenser as substantially in the plane of its drive roller 340. The view shows the crank 280 mounted to rock about its pin 282 whose two ends are connected to cheek plates or walls 342, 344 of the label dispenser 34, with the crank being subjected to the return force of the spring 290. Naturally, it is also possible to see the label drive roller whose pin 346 is motor-driven from a pulley 348 connected via a belt to the general mail item conveyor system (not shown) of the machine. Finally, the optical detection fork 288 serving to receive the detection end 286 of the crank 280 can be seen very clearly. The optical fork is mounted on an electronic detection circuit 350 secured to the dispenser and including conventional means for acquiring and processing optical signals, which means are electrically connected to the monitoring and control circuit 26 of the mail-handling machine.

It is known that the quality of the postage imprint affixed to a mail item depends directly on the thickness of the item, and that in order to maintain the quality for large thicknesses, it is necessary for the reference position corresponding to the triggering of the print control cycle to be modified relative to the edge of the mail item so that the printing is not performed too close to said edge.

Instead of the print control cycle being modified by adding a supplementary offset to the predetermined offset $\Delta_0$ (corresponding to a mail item of minimum thickness, i.e. 0.2 mm), such a supplementary offset being determined as a function of the thickness of the mail item, which requires the monitoring and control means 26 to be modified, as proposed in above-mentioned Patent Application FR97 01054, in the invention the print control cycle is modified by retarding the transmission of the signal representing the detection of the edge of the mail item, this retarding being obtained by modifying the structure of the detector 28 for detecting the edge of the mail item. Thus, the monitoring and control means are not modified, since the printing continues to be performed on the basis of the predetermined standard offset. In addition, it is no longer necessary to use special measurement means (Hall-effect detectors) in order to determine mail item thickness with precision, it merely being necessary to modify the structure of the detector for detecting the edges of the mail items in order to determine thickness directly (albeit with less precision).

Thus, with the invention, the crank 280 serves both to detect the edge of the mail item and also to detect its thickness.

Figure 4:
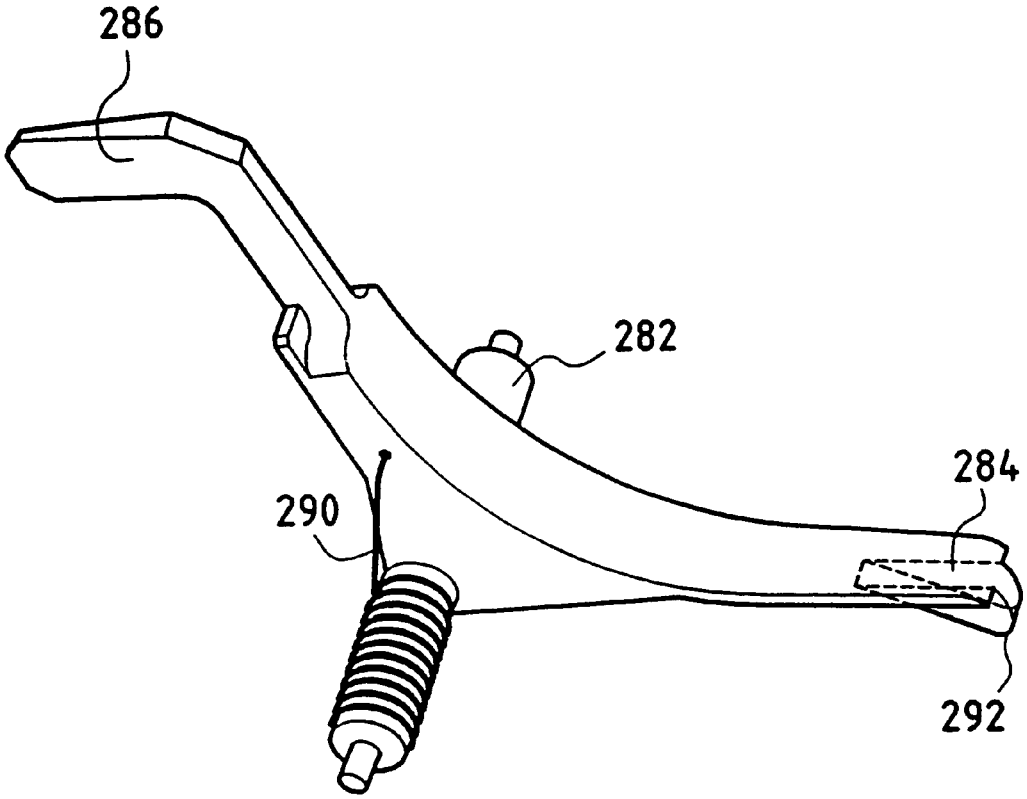
FIG. 4 is a perspective view of a detection crank of the invention.

The crank is shown in perspective in FIG. 4, and it is substantially swan-necked in shape with a convex top portion terminated by the detection end 286, and a concave bottom portion terminated by the feeler end 284, the pin about which the crank rocks being situated substantially where the two portions meet.

Figure 2:
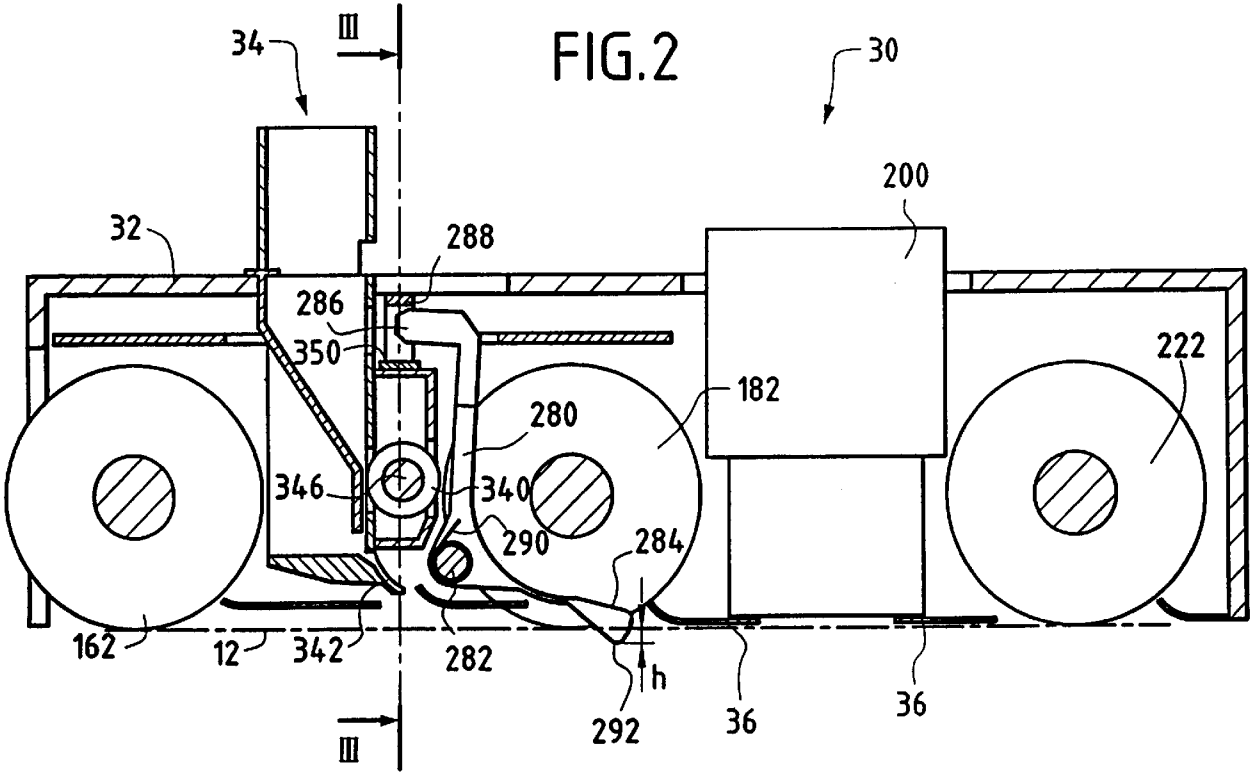
FIG. 2 is a longitudinal section view of a top portion of a selection, conveying, and franking module of the mail-handling machine of FIG. 1.

With reference to FIG. 2, it can be observed that the feeler end is provided with an impact zone 292 which co-operates with the leading edge of the mail item (envelope or label), and which is provided with a sloping profile (e.g. formed by a flat sloping at about 45° to the horizontal) which descends to a predetermined depth h below the level corresponding to the top surface of the mail item, which surface is defined by the reference top plane 36.

For mail item thicknesses in the range two tenths of a millimeter to about 16 mm, this depth may be estimated to be about 4 mm to 5 mm. For a different range of thicknesses, e.g. from 0 mm to 25 mm, it is necessary to adopt a depth that is also different.

Figure 5:
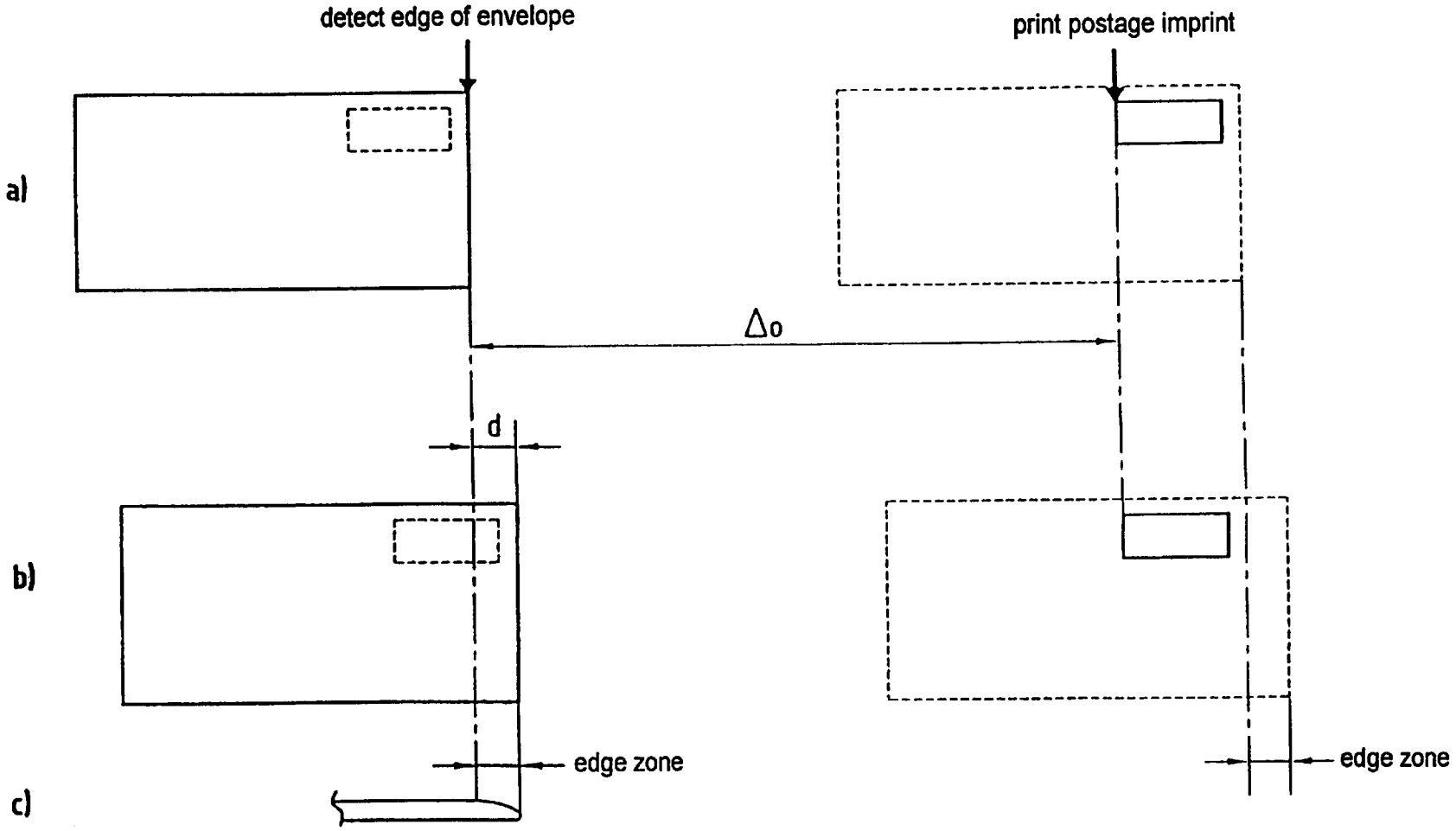
FIG. 5*a* 5*b*, and 5*c* show the print cycle whereby a postage imprint is printed.

The principle of the invention for offsetting the postage imprint is explained below with reference to FIG. 5.

At a) an envelope of small thickness, e.g. 2 mm, is shown for which detecting the edge of the envelope corresponds to detecting the real edge of the envelope. In which case, the postage imprint on the mail item is not offset, and printing the postage imprint is triggered conventionally after a predetermined standard offset $\Delta_0$.

At b) an envelope that is thicker, e.g. of thickness 12 mm, is shown. With such large thicknesses, it is more difficult to determine the real edge of the envelope, and there is a zone of uncertainty at the edge of the envelope, in which zone the printing quality might be mediocre since the envelope does not have a plane surface in this zone, as shown in FIG. 5*c*. Printing is also triggered after the standard offset $\Delta_0$. However, in this case, detecting the edge of the envelope no longer corresponds exactly to detecting the real edge of the envelope.

A triggering retard d appears relative to the real edge of the envelope. This retard in transmission of the edge-detection signal is obtained because of the sloping structure and because of the particular position of the feeler end of the crank 280, which end is positioned slightly below the conveyor path 12 (by a depth h). By putting off the detection of the edge of the envelope to the limit of the zone of uncertainty, this retard also causes an offset in the postage imprint relative to the real edge of the envelope (since the standard offset $\Delta_0$ of the printing is constant), thereby bringing the postage imprint out of the zone of uncertainty.

Thus, without a specific thickness measurement, and without modifying the print control cycle, the inventors have shown that it is possible to offset the postage imprint merely by modifying the structure of the detector for detecting the edge of the mail item. This particularly elegant solution also makes it possible to increase the reliability of the mail-handling machine. It also offers the major advantage that it can be adapted directly to fit conventional machines equipped with a single edge-detecting sensor and not provided with this imprint offset function.

What is claimed is:

1. A device for offsetting a postage imprint in a mail-handling machine, the device comprising detection means for detecting an edge of a mail item, print means for printing a postage imprint on the mail item, and monitoring and control means connected firstly to said detection means and secondly to said print means so as to control printing of said postage imprint on said mail item as a function of a predetermined standard offset $\Delta_0$ on the basis of the detection of said edge of the mail item, wherein said detection means for detecting an edge of the mail item comprise means for retarding the detection of the edge of the mail item as a function of the thickness of the mail item, which thickness is determined using said detection means for detecting an edge of a mail item.

2. A device for offsetting an imprint according to claim 1, wherein said detection means detect both an edge of an envelope, and an edge of a label.

3. A device for offsetting an imprint according to claim 1, wherein said monitoring and control means are of the microprocessor type.

4. A device for offsetting an imprint according to claim 1, wherein said detection means comprise a swan-necked bell-crank having a convex top portion which is terminated by a detection end, and a concave bottom portion which is terminated by a feeler end, a pin about which the crank can rock being situated substantially where the two portions meet.

5. A device for offsetting an imprint according to claim 4, wherein said feeler end is provided with an impact zone which co-operates with said edge of the mail item, and which has a profile that slopes down to a predetermined depth h below the level corresponding to a top surface of the mail item, which surface is defined by a reference top plate of the conveyor path along which the mail items are conveyed.

6. A device for offsetting an imprint according to claim 5, wherein said impact zone is formed of a flat sloping at about 45° to the horizontal.

7. A device for detecting an edge of a mail item in a mail-handling machine, said device comprising a swan-necked bell-crank having a convex top portion which is terminated by a detection end, and a concave bottom portion which is terminated by a feeler end, a pin about which the crank can rock being situated substantially where the two portions meet.

8. A detection device according to claim 7, wherein said feeler end is provided with an impact zone which has a sloping profile serving to co-operate with said edge of the mail item.

9. A method of offsetting a postage imprint in a mail-handling machine, said method comprising a first step using detection means to detect an edge of a mail item, a second step using monitoring and control means connected to said detection means to deliver a predetermined standard offset $\Delta_0$ as of the detection of said edge of a mail item, and a third step using print means connected to said monitoring and control means to print the postage imprint on the mail item, wherein the detection of the edge of the mail item that is performed in the first step is retarded as a function of dimensional characteristics of the mail item, as determined using said detection means for detecting an edge of the mail item.

10. A method of offsetting a postage imprint according to claim 9, wherein said dimensional characteristics are constituted by the various thicknesses of the selected mail items.

* * * * *